US010953516B2

(12) United States Patent
Takenouchi

(10) Patent No.: US 10,953,516 B2
(45) Date of Patent: Mar. 23, 2021

(54) GRINDING APPARATUS

(71) Applicant: DISCO CORPORATION, Tokyo (JP)

(72) Inventor: Kenji Takenouchi, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 355 days.

(21) Appl. No.: 16/010,706

(22) Filed: Jun. 18, 2018

(65) Prior Publication Data

US 2018/0369990 A1 Dec. 27, 2018

(30) Foreign Application Priority Data

Jun. 23, 2017 (JP) ..... JP2017-123036

(51) Int. Cl.

| | |
|---|---|
| ***B24B 1/00*** | (2006.01) |
| ***B24D 3/34*** | (2006.01) |
| ***B24B 55/02*** | (2006.01) |
| ***B24B 7/22*** | (2006.01) |
| ***B24D 3/14*** | (2006.01) |
| ***B24D 7/06*** | (2006.01) |
| ***B24D 7/10*** | (2006.01) |

(52) U.S. Cl.

CPC ..... *B24D 3/346* (2013.01); *B24B 7/228* (2013.01); *B24B 55/02* (2013.01); *B24D 3/14* (2013.01); *B24D 3/342* (2013.01); *B24D 7/066* (2013.01); *B24D 7/10* (2013.01)

(58) Field of Classification Search

CPC ..... B24D 3/346; B24B 55/02; B24B 7/228
USPC ..... 451/41, 63, 123, 242, 246
See application file for complete search history.

(56) References Cited

U.S. PATENT DOCUMENTS

| | | | | |
|---|---|---|---|---|
| 5,971,836 | A * | 10/1999 | Kogure | B24B 27/0053 257/E21.237 |
| 6,050,876 | A * | 4/2000 | Ouyang | G01M 17/022 451/254 |
| 6,533,641 | B1 * | 3/2003 | Morken | B24B 9/065 451/285 |
| 8,494,671 | B2 * | 7/2013 | Akiyama | B24B 49/12 700/170 |
| 2016/0035579 | A1 * | 2/2016 | Kido | C30B 33/00 438/693 |

FOREIGN PATENT DOCUMENTS

JP 2001284303 A 10/2001

* cited by examiner

*Primary Examiner* — Joseph J Hail
*Assistant Examiner* — Shantese L McDonald
(74) *Attorney, Agent, or Firm* — Greer, Burns & Crain, Ltd.

(57) ABSTRACT

A grinding apparatus includes: a holding table for holding a workpiece thereon; a grinding unit including a grinding wheel for grinding the workpiece held on the holding table, the grinding wheel including a grinding stone made of abrasive grains and grains of photocatalyst bonded by a vitrified bonding material; a grinding water supply unit configured to supply grinding water to the grinding stone when the workpiece held on the holding table is ground by the grinding unit; and a light applying unit disposed adjacent to the holding table and configured to apply light to a grinding surface of the grinding stone while the workpiece held on the holding table being ground.

8 Claims, 7 Drawing Sheets

GRINDING APPARATUS

BACKGROUND OF THE INVENTION

Field of the Invention

The present invention relates to a grinding apparatus that includes a holding table for holding a workpiece thereon and grinding means having a grinding wheel for grinding the workpiece which is held on the holding table.

Description of the Related Art

Plate-shaped workpieces such as semiconductor wafers and so on are thinned to a predetermined thickness by being ground by a grinding apparatus (see, for example, Japanese Patent Laid-Open No. 2001-284303), and then divided by a cutting apparatus or the like into individual device chips, which will be used in various electronic appliances.

SUMMARY OF THE INVENTION

If a wafer to be ground by the grinding stones of a grinding wheel is made of a hard-to-grind material such as gallium nitride (GaN), silicon carbide (SiC), gallium arsenide (GaAs), or the like, then the wafer tends to wear the grinding stones rather intensively in a short period of time, resulting in an increase in the cost expended to produce device chips from the wafer. When a grinding wheel is to grind a wafer made of metal or a wafer having metal electrodes exposed on a surface thereof to be ground, the ductility of the metal is liable to make it difficult for the grinding wheel to grind the wafer.

It is therefore an object of the present invention to provide a grinding apparatus which is capable of preventing grinding stones thereof from being worn excessively by a workpiece that is being ground by the grinding apparatus and which is capable of grinding a workpiece smoothly when the workpiece is made of a hard-to-grind material or when the workpiece contains metal.

In accordance with an aspect of the present invention, there is provided a grinding apparatus including: a holding table for holding a workpiece thereon; a grinding unit including a grinding wheel for grinding the workpiece held on the holding table, the grinding wheel including a grinding stone made of abrasive grains and grains of photocatalyst bonded by a vitrified bonding material; a grinding water supply unit configured to supply grinding water to the grinding stone when the workpiece held on the holding table is ground by the grinding unit; and a light applying unit disposed adjacent to the holding table and configured to apply light to a grinding surface of the grinding stone while the workpiece held on the holding table being ground.

The light applying unit should preferably be positioned immediately before a point where the grinding wheel starts to go onto the workpiece held on the holding table on a path along which the grinding wheel rotates about its own axis.

The light applying unit should preferably include a light emitter for emitting the light and a cleaning water supply for supplying cleaning water to the light emitter.

In the grinding apparatus, the grinding wheel includes the grinding stone made of abrasive grains and grains of photocatalyst bonded by a vitrified bonding material. The grinding apparatus includes the grinding water supply unit configured to supply grinding water to the grinding stone when the workpiece held on the holding table is ground by the grinding unit, and the light applying unit disposed adjacent to the holding table and configured to apply light to the grinding surface of the grinding stone while the workpiece held on the holding table being ground. Therefore, during a grinding process, the grinding stone that goes onto the workpiece is efficiently made hydrophilic, so that the cooling effect of grinding water is increased to prevent the grinding stone from being excessively worn, and the ability to discharge ground-off debris is increased. Furthermore, since the grinding stone that has been made hydrophilic supplies grinding water effectively to the processing region where the grinding stone grinds the workpiece, the processed quality of the workpiece is prevented from being lowered due to processing heat. Even if the workpiece includes a wafer made of a hard-to-grind material, the grinding apparatus is capable of smoothly grinding the workpiece.

When grinding water supplied to the grinding stone and the grains of photocatalyst in the grinding stone to which light is applied are brought into contact with each other, the grinding water that is supplied develops an oxidizing power due to hydroxy radicals. Even if the workpiece is a wafer made of a hard-to-grind material, the surface of the workpiece to be ground is oxidized and embrittled by the strong oxidizing power of the hydroxy radicals, and hence the workpiece can smoothly be ground by the grinding wheel. Similarly, even if the workpiece is a wafer made of metal or a wafer having metal electrodes partly exposed on a reverse side thereof, since the metal is oxidized and embrittled by the strong oxidizing power of the hydroxy radicals, the workpiece can smoothly be ground by the grinding wheel.

In case the light applying unit is positioned immediately before the point where the grinding wheel starts to go onto the workpiece held on the holding table on the path along which the grinding wheel rotates about its own axis, the grinding stone of the grinding wheel is made highly hydrophilic immediately before the grinding stone starts to go onto the workpiece, with the results that the cooling effect of the grinding water is further increased to further prevent the grinding stones from being worn, and the ability to discharge ground-off debris is further increased.

In case the light applying unit includes the light emitter for emitting the light and the cleaning water supply for supplying cleaning water to the light emitter, the light is prevented from failing to be applied to the grinding stone owing to contamination of the light emitter by ground-off debris.

The above and other objects, features and advantages of the present invention and the manner of realizing them will become more apparent, and the invention itself will best be understood from a study of the following description and appended claims with reference to the attached drawings showing preferred embodiment of the invention.

DETAILED DESCRIPTION OF THE PREFERRED EMBODIMENT

Figure 1:
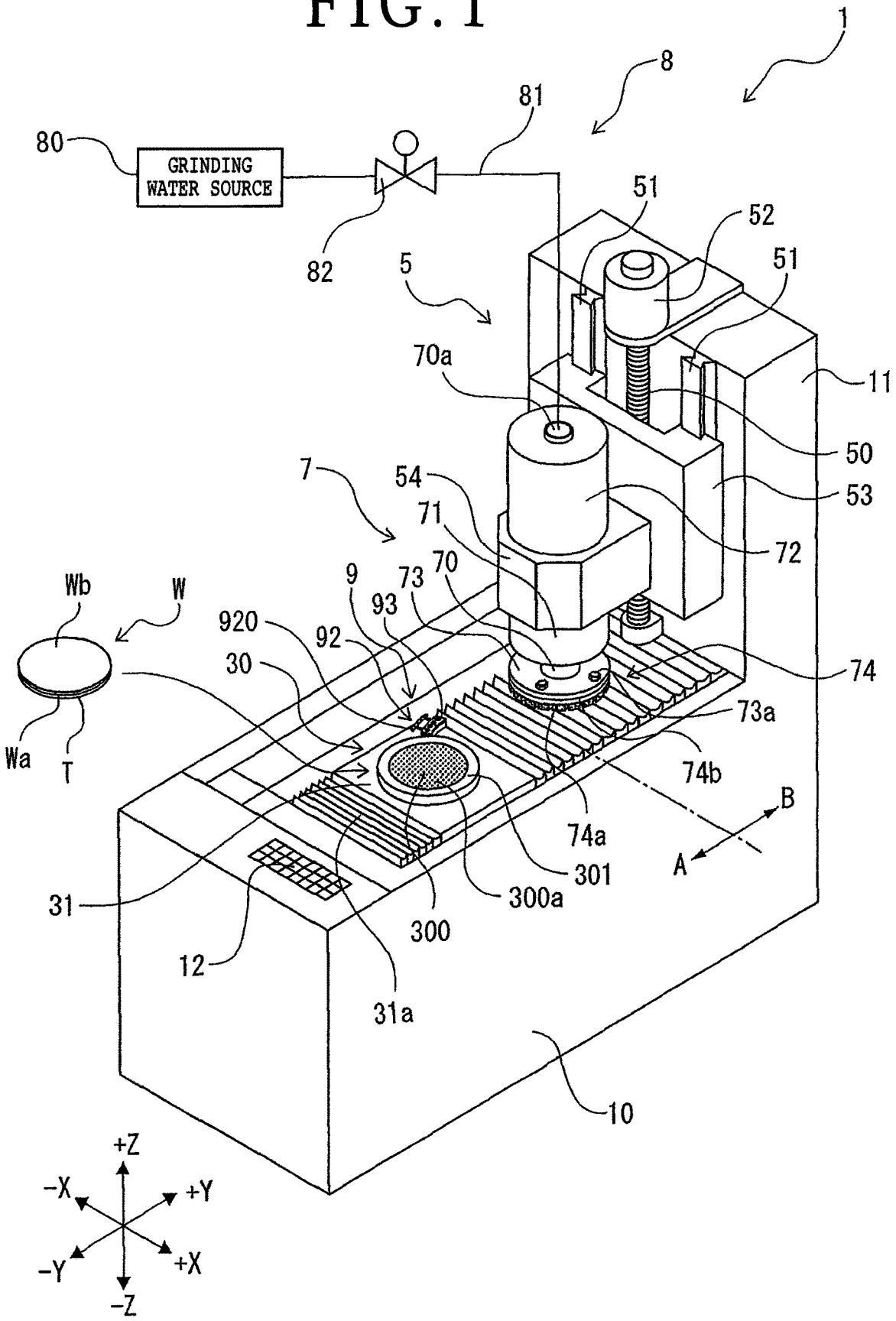
FIG. 1 is a perspective view of a grinding apparatus according to an embodiment of the present invention.

FIG. 1 depicts in perspective a grinding apparatus 1 according to an embodiment of the present invention. As depicted in FIG. 1, the grinding apparatus 1 includes a holding table 30 for holding a workpiece W thereon and grinding means or grinding unit 7 having a grinding wheel 74 for grinding the workpiece W held on the holding table 30. The grinding apparatus 1 also includes a base 10 having an upper surface that is divided into a front area, which extends in a −Y-axis direction, serving as a loading/unloading area A where the workpiece W can be placed on and removed from the holding table 30, and a rear area, which extends in a +Y-axis direction, serving as a grinding area B where the workpiece W can be ground by the grinding means 7. Input means 12 that is used by the operator of the grinding apparatus 1 to enter processing conditions, etc. into the grinding apparatus 1 is disposed on the upper surface of a front portion of the base 10.

The holding table 30 has a circular contour, for example, and includes an attracting unit 300 for attracting the workpiece W under suction and a frame 301 that supports the attracting unit 300. The attracting unit 300 is held in fluid communication with a suction source, not depicted, and has an upwardly exposed porous surface serving as a holding surface 300*a* for holding the workpiece W under a suction force that is applied from the suction source to the holding surface 300*a*. The holding surface 300*a* includes a conical surface which is extremely gradually slanted around a central apex thereof that is held in alignment with the center of rotation of the holding table 30. The holding table 30, which is horizontally surrounded by a cover 31, is rotatable about a vertical axis extending in Z-axis directions by rotating means, not depicted, and reciprocally movable in the Y-axis directions between the loading/unloading area A and the grinding area B by Y-axis delivery means, not depicted, disposed below the cover 31 and a bellows cover 31*a* that is coupled to the cover 31.

An upstanding column 11 that extends upwardly from the base 10 is disposed in a rear end portion of the grinding area B. Grinding-feed means 5 for grinding-feeding the grinding means 7 downwardly in a −Z-axis direction is mounted on a front side surface of the column 11. The grinding-feed means 5 includes a ball screw 50 having a central axis extending in the Z-axis directions, a pair of guide rails 51 each disposed on each side of the ball screw 50 and extending parallel thereto, an electric motor 52 coupled to the upper end of the ball screw 50 for rotating the ball screw 50 about its own central axis, a vertically movable plate 53 having an internal nut threaded over the ball screw 50 and a pair of side feet held in slidable contact with the respective guide rails 51, and a holder 54 coupled to the vertically movable plate 53 and holding the grinding means 7. When the electric motor 52 is energized to rotate the ball screw 50 in one direction about its central axis, the vertically movable plate 53 is moved downwardly in the −Z-axis direction along the guide rails 51 by the ball screw 50, thereby grinding-feeding the grinding means 7 held by the holder 54 downwardly in the −Z-axis direction. When the electric motor 52 is reversed, the ball screw 50 is rotated in the opposite direction, moving the vertically movable plate 53 upwardly in the +Z-axis direction along the guide rails 51.

The grinding means 7 includes a rotational shaft 70 having a central axis extending in the Z-axis directions, a housing 71 by which the rotational shaft 70 is rotatably supported, an electric motor 72 for rotating the rotational shaft 70 about its central axis, a mount 73 coupled to the lower distal end of the rotational shaft 70, and the grinding wheel 74 that is detachably mounted on the lower surface of the mount 73.

Figure 2:
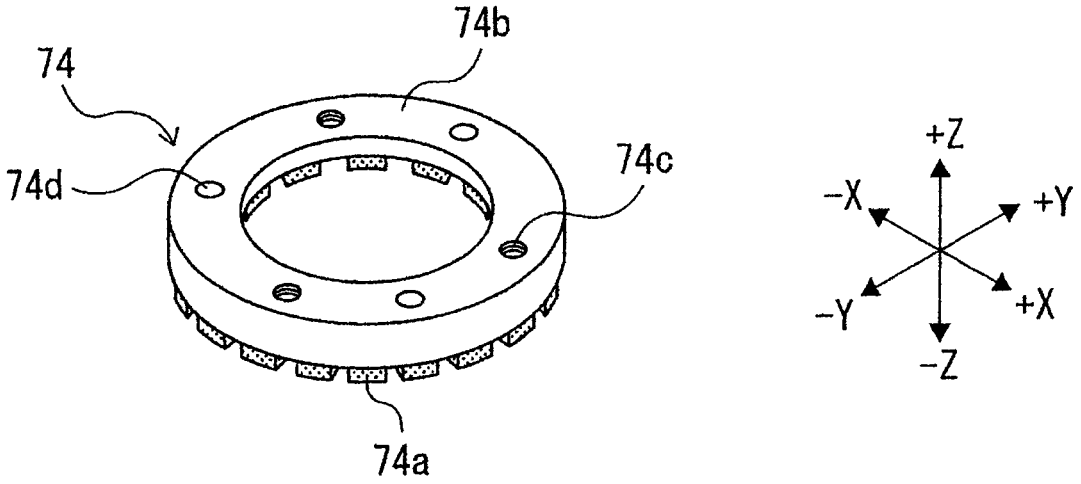
FIG. 2 is a perspective view of a grinding wheel of the grinding apparatus.
Figure 3:
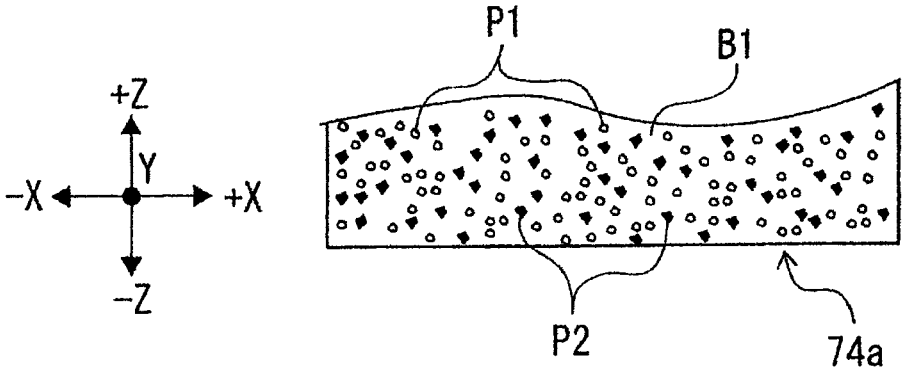
FIG. 3 is an enlarged fragmentary front elevational view of a grinding stone of the grinding wheel.

As depicted in FIG. 2, the grinding wheel 74 includes an annular wheel base 74*b* and a plurality of grinding stones 74*a*, each substantially in the shape of a rectangular parallelepiped, arranged in an annular array on the bottom surface (free end) of the wheel base 74*b*. The wheel base 74*b* has a plurality of screw holes 74*c* defined therein which are open at an upper surface thereof and a plurality of ejection ports 74*d* defined therein which extend axially through the wheel base 74*b* and are open at both upper and lower surfaces thereof, for ejecting grinding water toward the grinding stones 74*a*. As depicted in FIG. 3, each of the grinding stones 74*a* is made of a mixture of abrasive grains P1 of diamond and grains P2 of photocatalyst (e.g., grains of titanium oxide ($TiO_2$)), bonded by a vitrified bonding material B1 such as glass or ceramics. The grinding stones 74*a* may be of an integral annular shape, and the grains P2 of photocatalyst may be grains of tin oxide, grains of zinc oxide, grains of cerium oxide, or the like. The grinding wheel 74 is fastened to the lower surface of the mount 73 by screws 73*a* depicted in FIG. 1 that are threaded through respective holes defined in the mount 73 into the respective screw holes 74*c* in the wheel base 74*b*.

The grinding wheel 74 is manufactured as follows: First, a vitrified bonding material B1 is mixed with abrasive grains P1 of diamond having a grain size #1000 and grains P2 of photocatalyst, after which they are stirred into a mixture. The vitrified bonding material B1 may be, for example, silicon dioxide ($SiO_2$) as a chief component with a trace amount of additive added thereto for controlling the melting point thereof. Then, the mixture is heated at a predetermined temperature and pressed essentially into a rectangular parallelepiped. Thereafter, the pressed mixture is sintered at a high temperature, thereby fabricating a grinding stone 74*a*. The content of the grains P2 of photocatalyst in the grinding stone 74*a* is 15% by weight, for example. A plurality of grinding stones 74*a* thus fabricated are arrayed in an annular pattern on and secured to the bottom surface of a wheel base 74*b*, so that a grinding wheel 74 is manufactured. The grain size of the abrasive grains P1 of diamond is not limited to the example in the present embodiment, but may be varied depending on the kind and content, etc. of the grains P2 of photocatalyst.

The rotational shaft 70 depicted in FIG. 1 has a flow channel 70*a* extending axially therethrough in the Z-axis directions and held in fluid communication with grinding water supply means 8 or grinding water supply unit that supplies grinding water to the grinding stones 74*a*. The flow channel 70*a* serves as a passageway for grinding water. Grinding water that has passed through the flow channel 70*a* flows through the mount 73 and is ejected from the ejection ports 74*d* in the wheel base 74*b* toward the grinding stones 74*a*.

As depicted in FIG. 1, the grinding water supply means 8 includes a grinding water source 80 storing water, e.g., pure water, therein, a pipe 81 connected to the grinding water source 80 and held in fluid communication with the flow channel 70*a*, and a regulator valve 82 connected to the pipe 81 at an arbitrary position for regulating the rate at which grinding water flows through the pipe 81.

Figure 4:
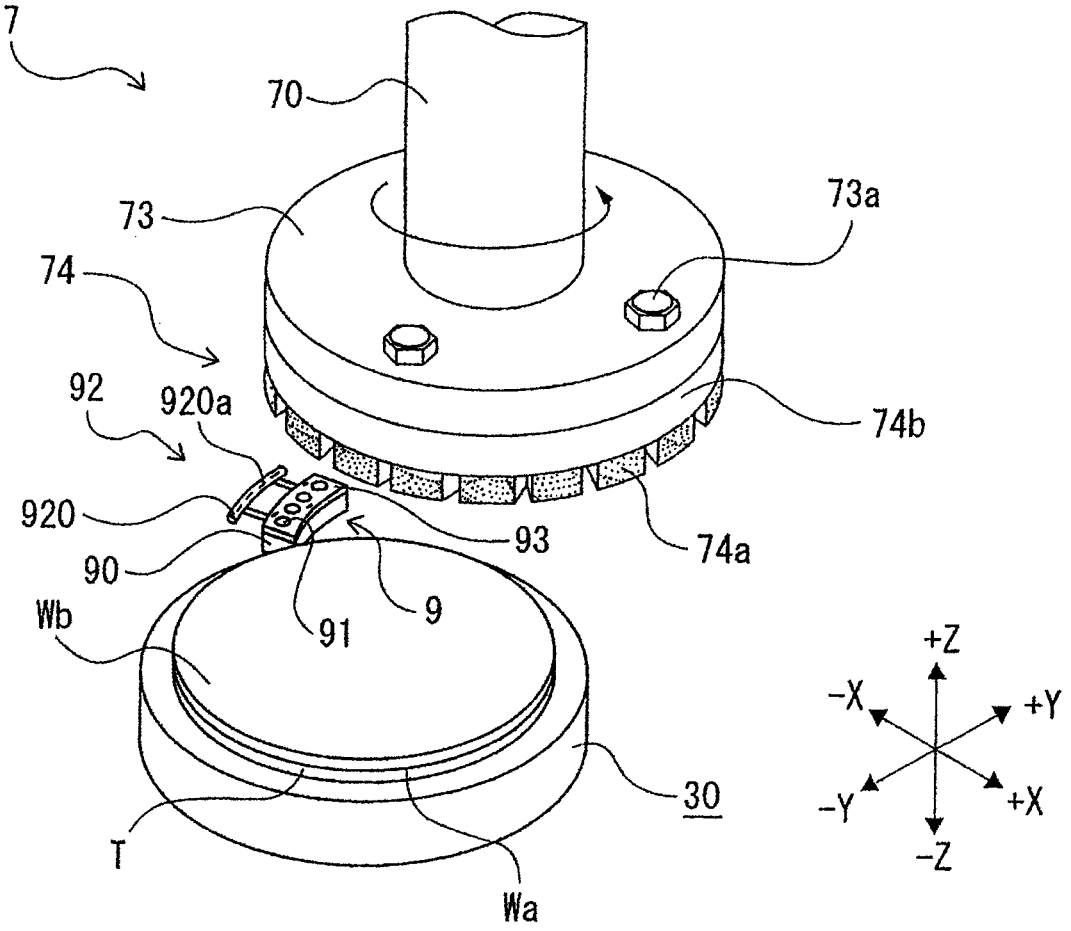
FIG. 4 is a perspective view depicting by way of example of the positional relationship between grinding means, a holding table, and light applying means of the grinding apparatus.

As depicted in FIGS. 1 and 4, the grinding apparatus 1 includes light applying means 9 or light applying unit disposed adjacent to the holding table 30, for applying light to the grinding surfaces, i.e., lower surfaces, of the grinding stones 74*a* that grind the workpiece W held on the holding table 30. As depicted in FIG. 4, the light applying means 9 includes: a base 90 having a substantially arcuate contour, for example; a plurality of (four in the illustrated embodiment) light emitters 91 arrayed on an upper surface of the base 90; a cleaning water supply 92 for supplying cleaning water, e.g., pure water, to the light emitters 91; and a plate-shaped cover 93 disposed over the light emitters 91, for preventing the light emitters 91 from being smeared.

The light emitters 91, which are embedded in respective cavities defined in the upper surface of the base 90, include light emitting diodes (LEDs) that are capable of emitting light having a predetermined wavelength, and are selectively turned on and off by a power supply, not depicted. If the grains P2 of photocatalyst that are contained in the grinding stones 74*a* are grains of titanium oxide as described above, then the wavelength of the light (ultraviolet light) emitted by the light emitters 91 should preferably be in the range of 201 to 400 nm, and more preferably be in the range of 201 to 365 nm. The light emitters 91 are not limited to LEDs for emitting ultraviolet light depending on the kind of the grains P2 of photocatalyst. For example, if the grains P2 of photocatalyst include grains of nitrogen-doped titanium oxide, i.e., titanium oxide doped with nitrogen that is rendered photocatalytically active when irradiated with visible light rays, then the light emitters 91 may include a xenon lamp, a fluorescent lamp, or the like that emits visible light rays having a wavelength in the range of 400 to 740 nm.

The plate-shaped cover 93 is made of a transparent material such as glass or the like that transmits therethrough light emitted by the light emitters 91, for example. The plate-shaped cover 93 is fixed to the upper surface of the base 90 in covering relation to the light emitters 91. For example, the base 90 is vertically movable by Z-axis moving means, not depicted, so as to be able to set the vertical position of the upper surface of the cover 93 to a desired vertical position in view of the grinding-feed position of the grinding stones 74 in a grinding process.

Figure 5:
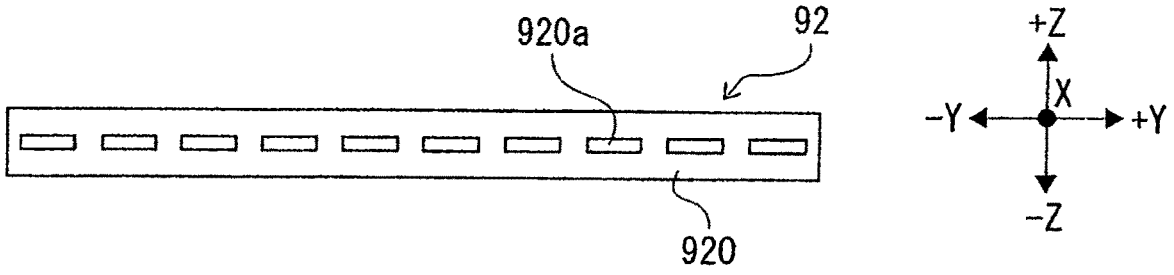
FIG. 5 is a view depicting an array of ejection ports according to an example.
Figure 6:
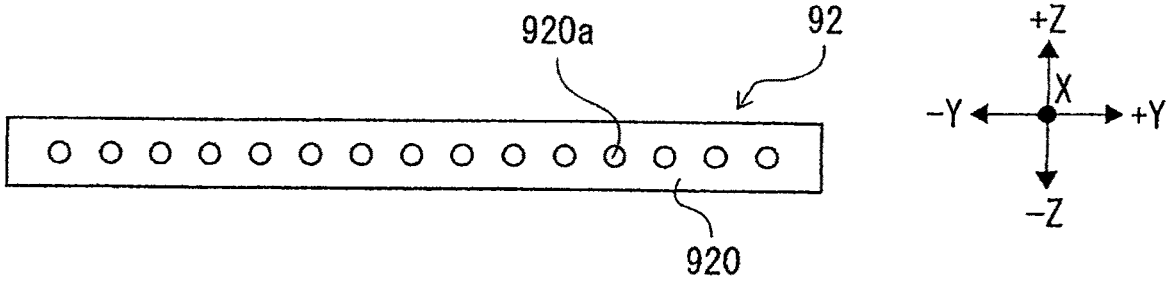
FIG. 6 is a view depicting an array of ejection ports according to another example.
Figure 7:
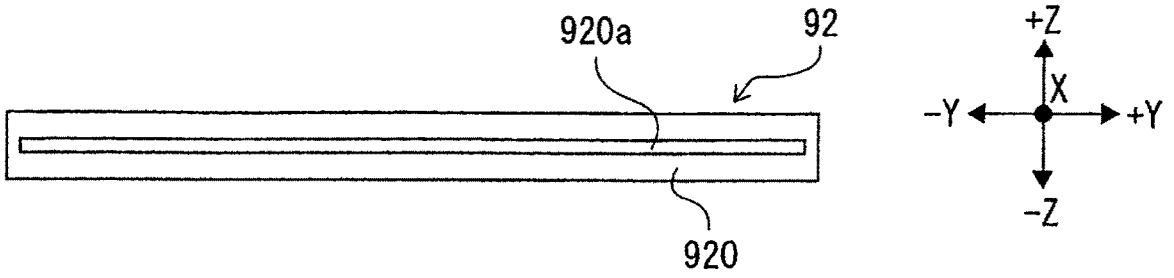
FIG. 7 is a view depicting an ejection port according to still another example.

The cleaning water supply 92 includes a cleaning water source, not depicted, storing water, e.g., pure water, therein, and a cleaning water nozzle 920 held in fluid communication with the cleaning water source. The cleaning water nozzle 920 is fixed to a side surface of the base 90 and extends along the base 90. The cleaning water nozzle 920 has a plurality of ejection ports 920*a* arrayed in longitudinal directions thereof for ejecting cleaning water toward the light emitters 91. The shape and size of the ejection ports 920*a*, and the angle of the ejection ports 920*a* with respect to the light emitter 91 are established such that they can streamline ejected cleaning water on the upper surface of the cover 93. As depicted in FIGS. 4 and 5, the ejection ports 920*a* should preferably be in the form of narrow slits and arrayed on a side surface of the cleaning water nozzle 920. However, the ejection ports 920*a* are not limited to such a structure. As depicted in FIG. 6, the ejection ports 920*a* may be in the form of round holes and arrayed on the side surface of the cleaning water nozzle 920, for example. Further alternatively, the cleaning water nozzle 920 may have an ejection port 920*a* in the form of a single continuous narrow slit defined in the side surface thereof as depicted in FIG. 7.

Operation of the grinding apparatus 1 depicted in FIG. 1 for grinding the workpiece W thereon will be described below.

The workpiece W, which is of a circular contour as depicted in FIG. 1, is a semiconductor wafer made of a hard-to-grind material of SiC, for example. The workpiece W has a number of devices formed on a face side Wa thereof which faces downwardly in FIG. 1, in a grid of respective areas demarcated by projected dicing lines. A protective tape T for protecting the face side Wa is stuck to the face side Wa. The workpiece W has a reverse side Wb to be ground by the grinding wheel 74. The workpiece W is not limited to any shapes and kinds, and may be appropriately changed in relation to the grinding wheel 74. For example, the workpiece W may be a wafer made of GaAs, GaN, or the like, a wafer made of metal, or a wafer having metal electrodes partly exposed on a reverse side thereof.

In the loading/unloading area A, the workpiece W is placed on the holding surface 300*a* of the holding table 30 with the reverse side Wb facing upwardly. The suction force generated by the suction source, not depicted, is transmitted to the holding surface 300*a*, causing the holding table 30 to hold the workpiece W under suction on the holding surface 300*a*. The workpiece W is thus held under suction on the holding surface 300*a* along the gradually conical surface thereof.

The holding table 30 is moved in the +Y-axis direction to a position below the grinding means 7 by the Y-axis delivery means, not depicted, and the grinding wheel 74 and the workpiece W held on the holding table 30 are positioned with respect to each other. Specifically, the grinding wheel 74 and the workpiece W held on the holding table 30 are positioned such that the center of rotation of the grinding wheel 74 is offset from the center of rotation of the workpiece W by a predetermined distance in the +Y-axis direction, so that the grinding stones 74*a* will rotate along a path that passes through the center of rotation of the workpiece W. The holding table 30 is adjusted to tilt such that the holding surface 300*a* as the gradual conical surface lies parallel to the lower grinding surfaces of the grinding stones 74*a*, thereby making the reverse side Wb of the workpiece W parallel to the lower grinding surfaces of the grinding stones 74*a*.

Figure 8:
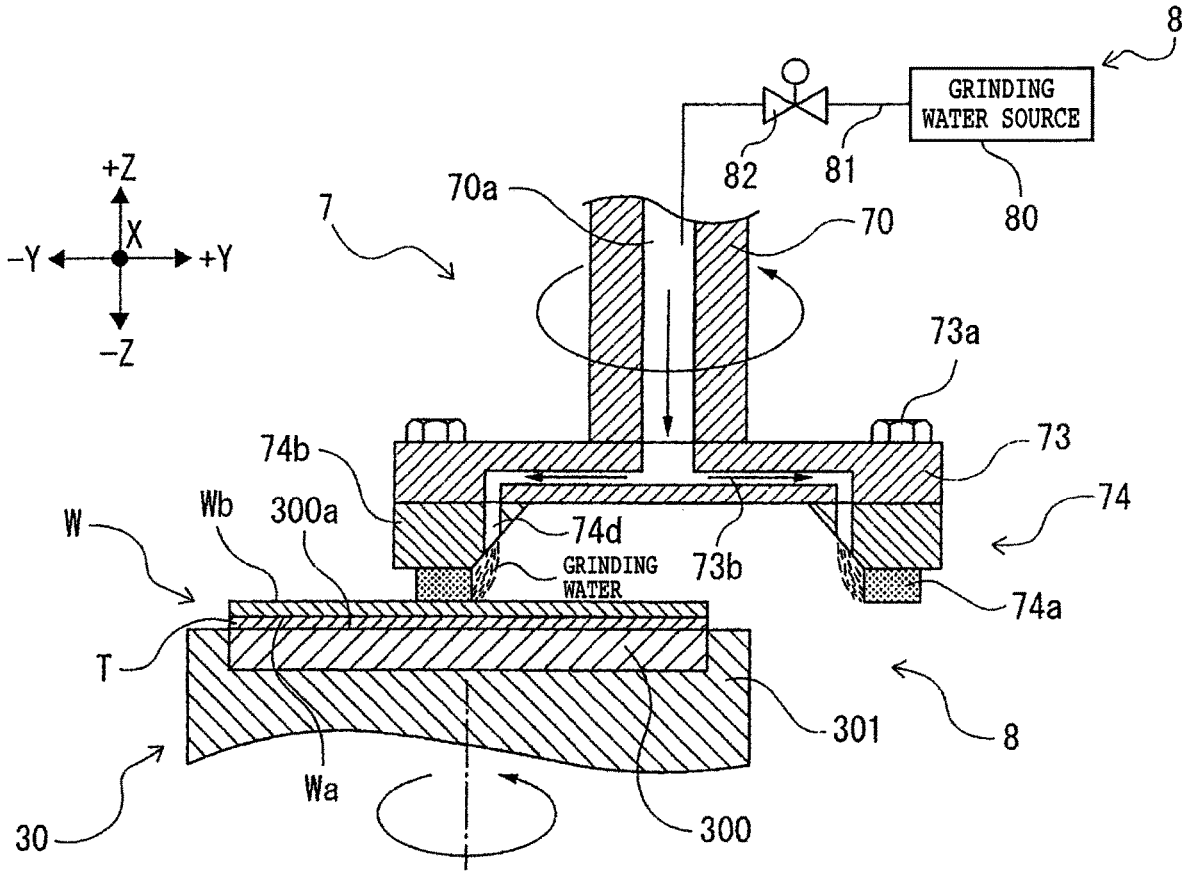
FIG. 8 is a cross-sectional view illustrating the manner in which a workpiece held on the holding table is ground by the grinding stones.

After the grinding wheel 74 and the workpiece W have been positioned with respect to each other, the electric motor 72 is energized to rotate the rotational shaft 70, rotating the grinding wheel 74 about its own axis counterclockwise as viewed in the +Z-axis direction, as depicted in FIG. 8. The grinding means 7 is fed in the −Z-axis direction by the grinding-feed means 5, lowering the grinding wheel 74 in the −Z-axis direction until the grinding stones 74*a* are brought into abutment against the reverse side Wb of the workpiece W, whereupon a grinding process starts to be performed on the workpiece W. During the grinding process, since the holding table 30 and hence the workpiece W are rotated about their own axis counterclockwise as viewed in the +Z-axis direction, the grinding stones 74*a* grinds the entire reverse side Wb of the workpiece W.

During the grinding process, the grinding water supply means 8 supplies grinding water to the flow channel 70*a* in the rotational shaft 70. As depicted in FIG. 8, the grinding water supplied to the flow channel 70*a* flows through flow channels 73*b* that are defined in the mount 73 at certain angular intervals in the circumferential directions of the mount 73, and is then ejected from the ejection ports 74*d* in the wheel base 74*b* toward the grinding stones 74*a*.

Conditions in the above grinding process are set as follows, for example:

Rotational speed of the grinding wheel 74: 3000 rpm

Grinding-feed speed: 1.5 μm/s

Rotational speed of the holding table 30: 40 rpm

Flow rate of grinding water: 3.0 L/min

Inasmuch as the workpiece W is held under suction on the holding surface 300*a* along the gradually conical surface thereof of the holding table 30, the grinding stones 74*a* abut against and grind the workpiece W in a region E (hereinafter referred to as "processing region E") in the path along which the grinding wheel 74 rotates, as indicated by the two-dot-and-dash lines in FIG. 9A.

Figure 9A:
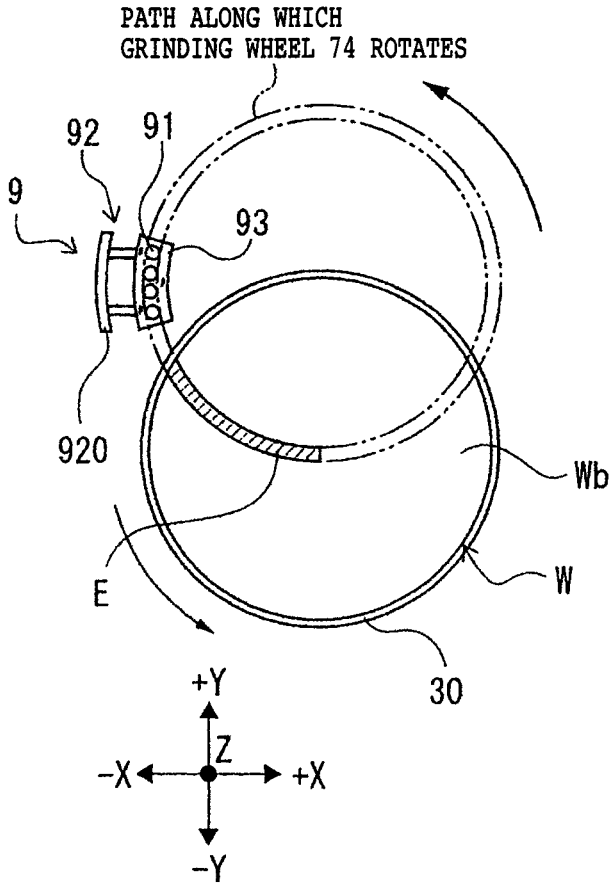
FIG. 9A is a plan view depicting the positional relationship between a path along which the grinding wheel rotates during a grinding process, an area of the workpiece which is processed by the grinding stones and the light applying means.

The light applying means 9 that is disposed adjacent to the holding table 30 is positioned immediately before a point where the grinding wheel 74 starts to go onto the workpiece W on the path along which the grinding wheel 74 rotates over the holding table 30, as depicted in FIG. 9A, i.e., immediately before a point where the grinding wheel 74 enters the processing region E, while the grinding wheel 74 and the holding table 30 has been positioned with respect to each other.

Figure 9B:
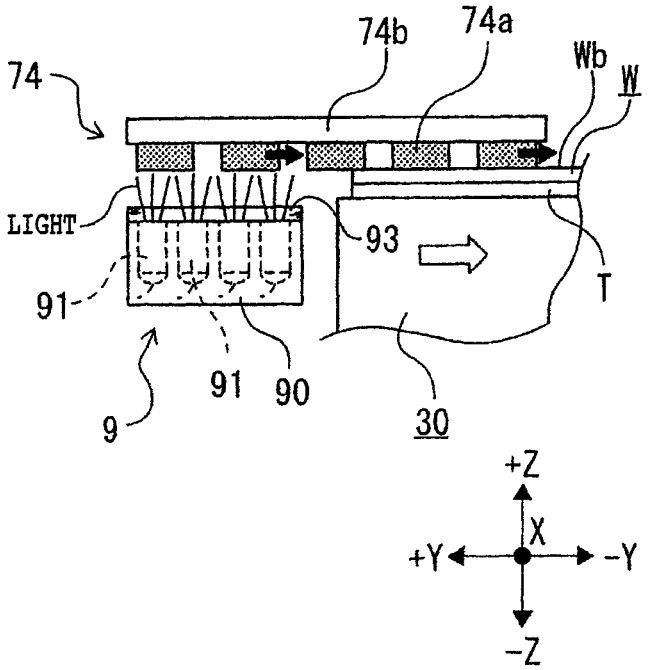
FIG. 9B is a fragmentary side elevational view depicting the manner in which grinding stones immediately after light is applied to their grinding surfaces go onto the workpiece.

As depicted in FIG. 9B, as the grinding process begins, the light emitters 91 are turned on, emitting light having a wavelength of 365 nm, for example (ultraviolet light) in the +Z-axis direction. The emitted light passes through the cover 93 and is applied to the lower surfaces of the grinding stones 74*a* immediately before they enter the processing region E. The applied light excites the grains P2 of photocatalyst existing in the grinding stones 74*a*. Specifically, the applied light excites the electrons in the valence band of the grains P2 of photocatalyst, producing two carriers, i.e., electrons and holes, therein.

The holes produced in the grains P2 of photocatalyst existing in the grinding stones 74*a* oxidize the grinding water that has been held in contact with the surfaces of the grains P2 of photocatalyst, generating hydroxy radicals that have a high oxidizing power. Therefore, the grinding water that has come into contact with the grinding surfaces of the grinding stones 74*a* is given the oxidizing power from the hydroxy radicals on at least the reverse side Wb of the workpiece W. Since the workpiece W of SiC is oxidized and embrittled by the hydroxy radicals, the workpiece W can easily be ground by the grinding wheel 74. Moreover, as the produced hydroxy radicals exist for a very short period of time, the grinding water does not oxide other parts of the workpiece W than the reverse side Wb thereof. The ejected grinding water also serves to cool the region where the grinding stones 74*a* and the reverse side Wb of the workpiece W are held in contact with each other and remove ground-off debris from the reverse side Wb of the workpiece W.

Even if the workpiece W is a wafer made of metal or a wafer having metal electrodes partly exposed on a reverse side thereof, since the metal is oxidized and embrittled by the strong oxidizing power of the hydroxy radicals, the workpiece W can smoothly be ground by the grinding wheel 74.

The applied light forms highly polar hydrophilic groups on the grinding surfaces of the grinding stones 74*a*, making the grinding surfaces of the grinding stones 74*a* hydrophilic. As a consequence, the grinding water is less likely to turn into water drops on the grinding surfaces of the grinding stones 74*a*, but tends to spread as a water film over the entire grinding surfaces of the grinding stones 74*a*. Therefore, the grinding stones 74*a* that have thus been made hydrophilic enter with a lot of grinding water into the processing region E where they grind the reverse side Wb of the workpiece W. Since a lot of grinding water is introduced into the region where the reverse side Wb of the workpiece W and the processing surfaces, i.e., the grinding surfaces, of the grinding stones 74*a* are held in contact with each other, the generation of frictional heat in that region is restrained. Consequently, the grinding stones 74*a* are prevented from being excessively worn, and the ability to discharge ground-off debris is increased. Furthermore, since the grinding stones 74*a* that have been made hydrophilic supply grinding water effectively to the processing region E where the grinding stones 74*a* grind the workpiece W, the processed quality of the workpiece W is prevented from being lowered due to processing heat.

As the light applying means 9 is positioned immediately before the point where the grinding wheel 74 starts to go onto the workpiece W on the path along which the grinding wheel 74 rotates on the holding table 30, the grinding stones 74*a* are made highly hydrophilic immediately before the grinding stones 74*a* start to go onto the workpiece W, with the results that the cooling effect of the grinding water is further increased to further prevent the grinding stones 74*a* from being worn, and the ability to discharge ground-off debris is further increased.

Figure 10:
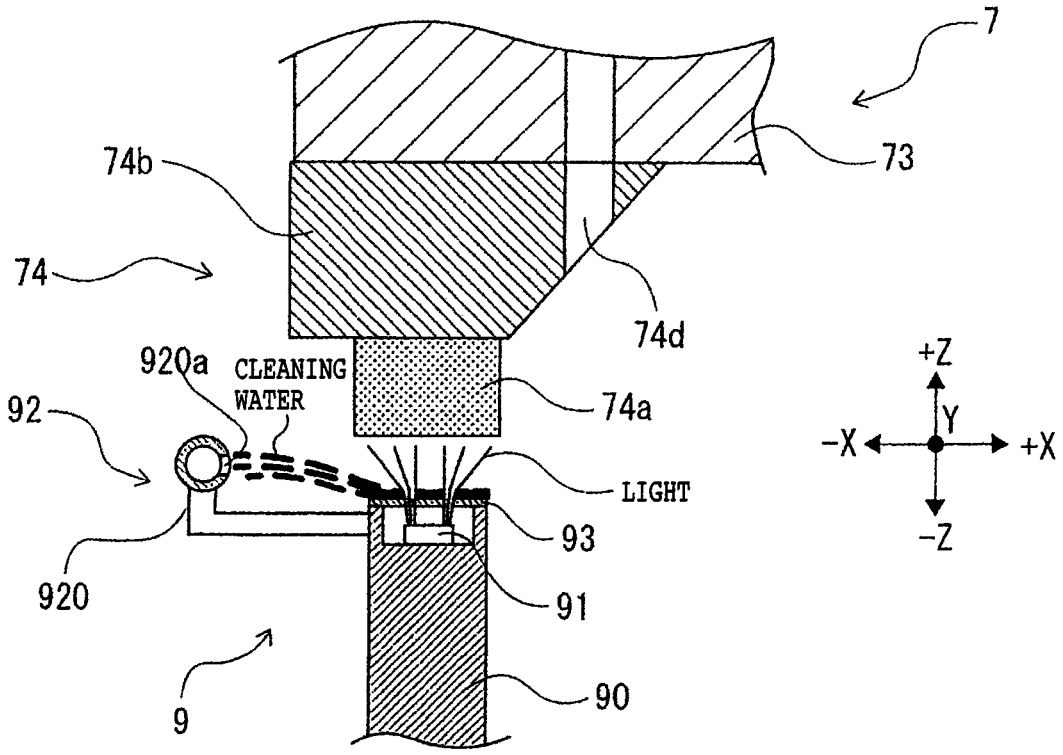
FIG. 10 is a fragmentary cross-sectional view depicting the manner in which cleaning water is supplied to a light emitter during the grinding process.

During the grinding process, as depicted in FIG. 10, the cleaning water supply 92 supplies cleaning water to the light emitters 91. Specifically, a cleaning water source, not depicted, supplies cleaning water to the cleaning water nozzle 920, and the supplied cleaning water is ejected from the ejection ports 920*a* out of the cleaning water nozzle 920 and lands on the cover 93 along a parabolic trajectory. The cleaning water is appropriately streamlined on the cover 93 and removes dirt such as ground-off debris from the cover 93, so that the light emitted from the light emitters 91 remains suitably applied to the processing surfaces of the grinding stones 74*a* at all times during the grinding process.

An experiment was conducted on workpieces W of SiC. According the results of the experiment, a conventional grinding apparatus took 110 seconds, but the grinding apparatus 1 according to the present invention took 90 seconds to grind a workpiece W of SiC by a thickness of 50 μm. Therefore, the grinding apparatus 1 according to the present invention was effective to reduce the grinding time. Furthermore, in grinding a Si surface of a workpiece W of SiC by 100, 83% of the entire grinding stones of the conventional grinding apparatus were worn, but only 57% of the entire grinding stones 74*a* of the grinding apparatus 1 according to the present invention were worn. In grinding a C surface of a workpiece W of SiC by 100, 60% of the entire grinding stones of the conventional grinding apparatus were worn, but 39% of the entire grinding stones 74*a* of the grinding apparatus 1 according to the present invention were worn.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A grinding apparatus comprising:

a holding table for holding a workpiece thereon;

a grinding unit including a grinding wheel for grinding the workpiece held on said holding table, said grinding wheel including a top surface, a bottom surface and an outer peripheral surface extending between said top surface and said bottom surface, said bottom surface of said grinding wheel including a grinding stone made of abrasive grains and grains of photocatalyst bonded by a vitrified bonding material;

a grinding water supply unit configured to supply grinding water to said grinding stone when the workpiece held on said holding table is ground by said grinding unit; and a light applying unit disposed adjacent to said holding table and a grinding surface of said grinding stone on said grinding wheel, said light applying unit configured to apply light to said grinding surface of said grinding stone prior to said grinding surface contacting the workpiece on said holding table.

2. The grinding apparatus according to claim 1, wherein said light applying unit is positioned immediately before a point where said grinding wheel starts to go onto the workpiece held on said holding table on a path along which said grinding wheel rotates about its own axis.

3. The grinding apparatus according to claim 1, wherein said light applying unit includes a light emitter for emitting said light and a cleaning water supply for supplying cleaning water to said light emitter.

4. The grinding apparatus according to claim 1, wherein said light applying unit includes a plurality of light emitters.

5. The grinding apparatus according to claim 4, wherein said light applying unit includes a base including said plurality of light emitters, and a transparent cover on said base that is positioned over said plurality of light emitters.

6. The grinding apparatus according to claim 1, wherein said light applying unit includes a cleaning water supply and ejection ports for ejecting the cleaning water, said ejection ports being narrow slits formed in said light applying unit.

7. The grinding apparatus according to claim 1, wherein said light applying unit includes a cleaning water supply and ejection ports for ejecting the cleaning water, said ejection ports being round holes formed in said light applying unit.

8. The grinding apparatus according to claim 1, wherein said light applying unit includes a cleaning water supply and an ejection port for ejecting the cleaning water, said ejection port being a narrow slit formed in said light applying unit.

* * * * *